US010003884B2

(12) United States Patent
Yoshino

(10) Patent No.: US 10,003,884 B2
(45) **Date of Patent: *Jun. 19, 2018**

(54) MICROPHONE APPARATUS

(71) Applicant: Satoshi Yoshino, Tokyo (JP)

(72) Inventor: Satoshi Yoshino, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/206,635

(22) Filed: Jul. 11, 2016

(65) Prior Publication Data

US 2017/0026741 A1 Jan. 26, 2017

(30) Foreign Application Priority Data

Jul. 24, 2015 (JP) ..... 2015-146347

(51) Int. Cl.

| | |
|---|---|
| ***H04R 3/00*** | (2006.01) |
| ***H04R 1/40*** | (2006.01) |
| *H04R 3/04* | (2006.01) |
| *H04R 1/22* | (2006.01) |
| *H04R 1/32* | (2006.01) |
| *H04R 5/027* | (2006.01) |

(52) U.S. Cl.

CPC ..... *H04R 1/406* (2013.01); *H04R 1/22* (2013.01); *H04R 1/326* (2013.01); *H04R 3/005* (2013.01); *H04R 3/04* (2013.01); *H04R 5/027* (2013.01); *H04R 2201/025* (2013.01); *H04R 2430/20* (2013.01)

(58) Field of Classification Search

CPC ..... H04R 5/27; H04R 3/005; H04R 1/326; H04R 1/406; H04R 1/22; H04R 2430/20

USPC ..... 381/111, 26, 92

See application file for complete search history.

(56) References Cited

U.S. PATENT DOCUMENTS

| | | | | |
|---|---|---|---|---|
| 4,466,117 A * | 8/1984 | Gorike | ..... | H04S 1/00 381/111 |
| 8,620,388 B2 * | 12/2013 | Hayakawa | ..... | G10L 21/0208 370/310.2 |
| 2006/0291672 A1 * | 12/2006 | Akino | ..... | H04R 3/00 381/111 |

(Continued)

FOREIGN PATENT DOCUMENTS

| | | |
|---|---|---|
| JP | 2011-29766 | 2/2011 |
| JP | 2015-111812 | 6/2015 |

*Primary Examiner* — Vivian Chin
*Assistant Examiner* — Ubachukwu Odunukwe
(74) *Attorney, Agent, or Firm* — Whitham, Curtis & Cook, P.C.

(57) ABSTRACT

A microphone apparatus includes a microphone including first and second bi-directional microphone units having respective directional axes arranged on two straight lines passing through one point and radially extending with an interval of 120 degrees in a circumferential direction, and an omnidirectional microphone unit arranged in sound collection regions of the first and second bi-directional microphone units, and a signal synthesis unit that synthesizes at least one of respective non-inverted signals and inverted signals of the first and second bi-directional microphone units and an output signal of the omnidirectional microphone unit to generate a plurality of output signals having directional axes in mutually different directions.

16 Claims, 15 Drawing Sheets

(56) References Cited

U.S. PATENT DOCUMENTS

2007/0242841 A1* 10/2007 Akino ..... H04R 19/04
381/174
2009/0190777 A1* 7/2009 Reining ..... H04R 1/38
381/92

* cited by examiner

MICROPHONE APPARATUS

BACKGROUND OF THE INVENTION

Technical Field

The present invention relates to a microphone apparatus.

Background Art

There is a microphone having a plurality of unidirectional microphone units incorporated in one housing to collect conversation by a plurality of speakers in a conference or the like. For example, a microphone having three unidirectional microphone units provided such that directional axes are radially positioned at intervals of 120 degrees, thereby to enable sound collection in all 360-degree directions is known.

However, such a conventional microphone cannot easily change directions of the directional axes, when the directions of the directional axes need to be changed, for example, in a case where three speakers sit in front of and on the right side and left side of the microphone in a conference or the like, and the position of the microphone cannot be changed.

To be specific, in the above-described example, by changing the directions of the microphone units in the housing such that the directional axes mutually make an angle of 90 degrees, more favorable sound collection can be realized. On the other hand, the conventional microphone has a configuration to physically change the directions of the microphone units in the housing (JP 2011-29766 A), and thus has a complicated configuration. Further, in such a conventional microphone, a user needs to change the directions of the microphone units in the housing. Further, such a conventional configuration has a problem that change of the direction of the directivity of the microphone would be difficult, when the microphone is installed in a place from which the microphone cannot be easily taken out, for example, when the microphone is embedded in a desk or hung from a ceiling.

JP 2015-111812 A discloses a microphone having one omnidirectional microphone unit and two bi-directional microphone units, and this microphone is a stereo microphone that obtains right and left channel signals.

SUMMARY OF INVENTION

An object of the present invention is to provide a microphone apparatus that can easily change the direction of the directional axis by electrical processing without physically changing the directions of the microphone units.

A microphone apparatus according to the present invention includes a microphone including first and second bi-directional microphone units having respective directional axes arranged on two straight lines passing through one point and radially extending with an interval of 120 degrees in a circumferential direction, and an omnidirectional microphone unit arranged in sound collection regions of the first and second bi-directional microphone units, and a signal synthesis unit configured to synthesize at least one of respective non-inverted signals and inverted signals of the first and second bi-directional microphone units and an output signal of the omnidirectional microphone unit to generate a plurality of output signals having directional axes in mutually different directions.

DESCRIPTION OF THE PREFERRED EMBODIMENTS

Figure 1:
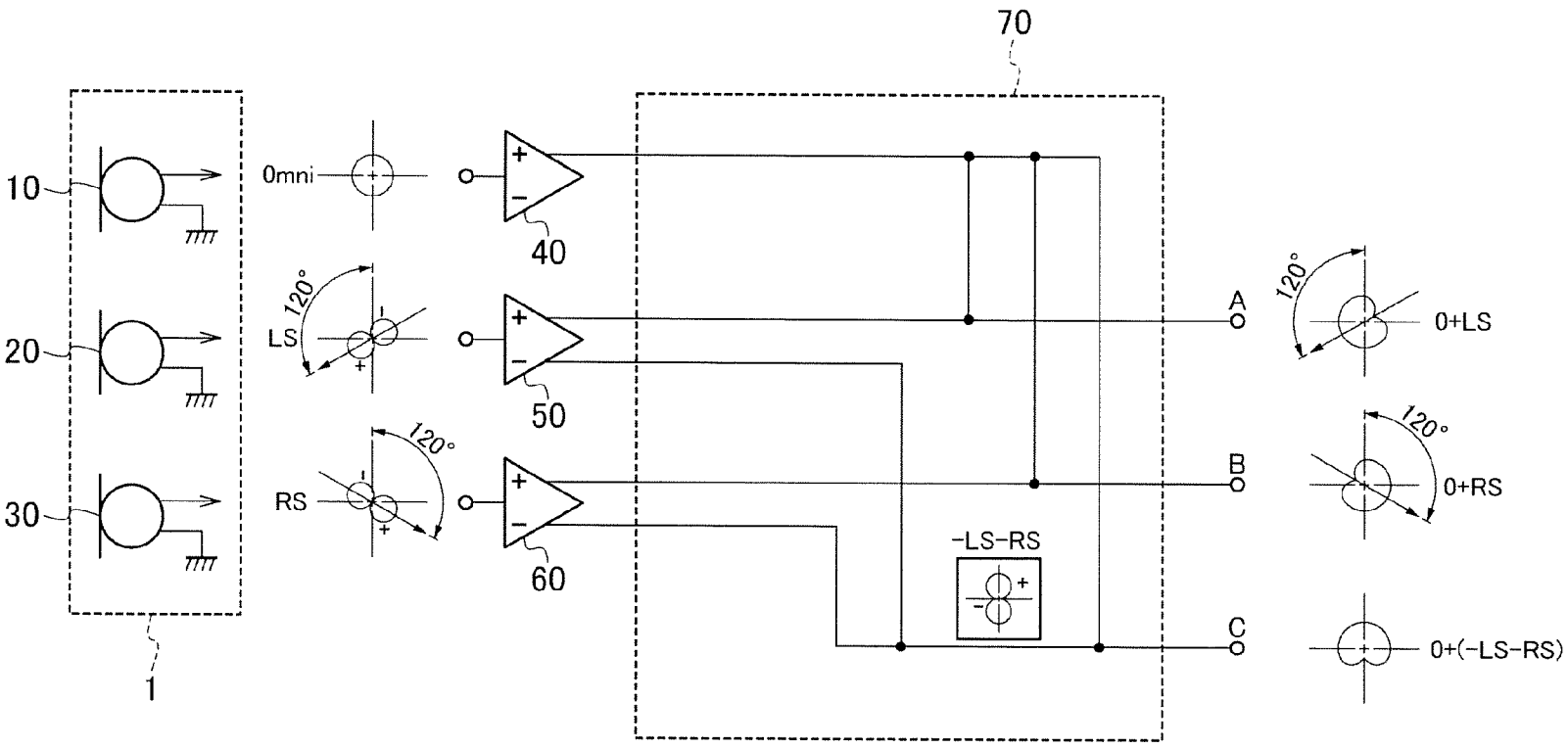
FIG. 1 is a circuit diagram of a microphone apparatus according to an embodiment of the present invention.

Hereinafter, a microphone apparatus according to an embodiment of the present invention will be described in detail with reference to the drawings. First, an embodiment of a microphone apparatus will be schematically described with reference to FIG. 1.

A microphone apparatus illustrated in FIG. 1 includes a microphone main body unit (hereinafter, simply referred to as microphone) 1 having three microphone units fixed and installed in a housing, and an output signal processing unit that processes output signals of the microphone units.

The three microphone units fixed and installed in the microphone 1 are made of one omnidirectional microphone unit 10, and two bi-directional microphone units 20 and 30. Physical arrangement and positional relationships of the microphone units 10, 20, and 30 will be described below with reference to FIG. 2.

The output signal processing unit includes signal amplification units 40, 50, and 60 that individually amplify the output signals of the microphone units 10, 20, and 30, and a synthesis circuit 70 as a signal synthesis unit provided at a subsequent stage of the signal amplification units 40, 50, and 60.

A signal amplification unit 50 as a first signal processing unit performs non-inverting amplification and inverting amplification for the output signal of the bi-directional microphone unit 20 and generates a positive-phase (+) non-inverted signal and a negative-phase (−) inverted signal. The signal amplification unit 50 outputs the positive-phase output signal and the inverted signal to the synthesis circuit 70. Similarly, a signal amplification unit 60 as a second signal processing unit performs non-inverting amplification and inverting amplification for the output signal of the bi-directional microphone unit 30, generates a positive-phase (+) non-inverted signal and negative-phase (−) inverted signal, and outputs the two generated signals to the synthesis circuit 70. Hereinafter, the signal amplification units 50 and 60 are also referred to as "non-inverting/inverting amplification circuits". The signal amplification unit 40 as a third signal processing unit amplifies the output signal of the omnidirectional microphone unit 10 and outputs the amplified output signal to the synthesis circuit 70, and is hereinafter also referred to as "signal amplification circuit".

The synthesis circuit 70 synthesizes the five amplified signals supplied from the signal amplification units 40, 50, and 60, and outputs output signals from three terminals A, B, and C. The output signals are supplied to an external device such as a mixer, and signal processing, sound recording, and the like are further performed. The synthesis circuit 70 will be described below in detail.

Next, a configuration of the microphone 1 will be described with reference to FIGS. 2 to 4.

Figure 2:
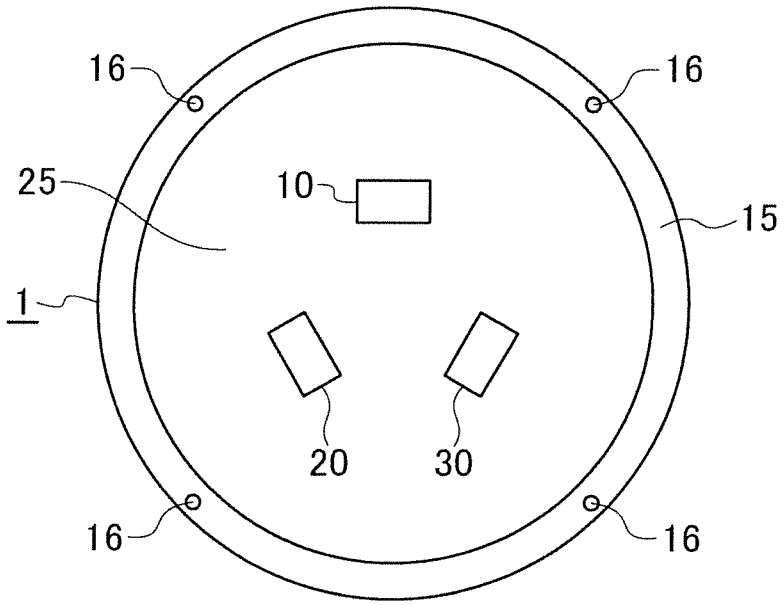
FIG. 2 is a plan view illustrating an arrangement example of microphone units in a microphone of the microphone apparatus.

The microphone 1 illustrated in FIG. 2 is a boundary microphone including a flat and round housing. In the microphone 1, the microphone units 10, 20, and 30 are fixed and installed on a substrate 25 provided in a lower case 15 of the housing. As the microphone units 10, 20, and 30, condenser microphone units are used in this example.

FIG. 2 illustrates a state in which an upper cover portion of the housing is removed. The upper cover portion is attached to the lower case 15 by being screwed into a plurality of screw holes 16 formed in a side edge of the lower case 15.

Figure 3:
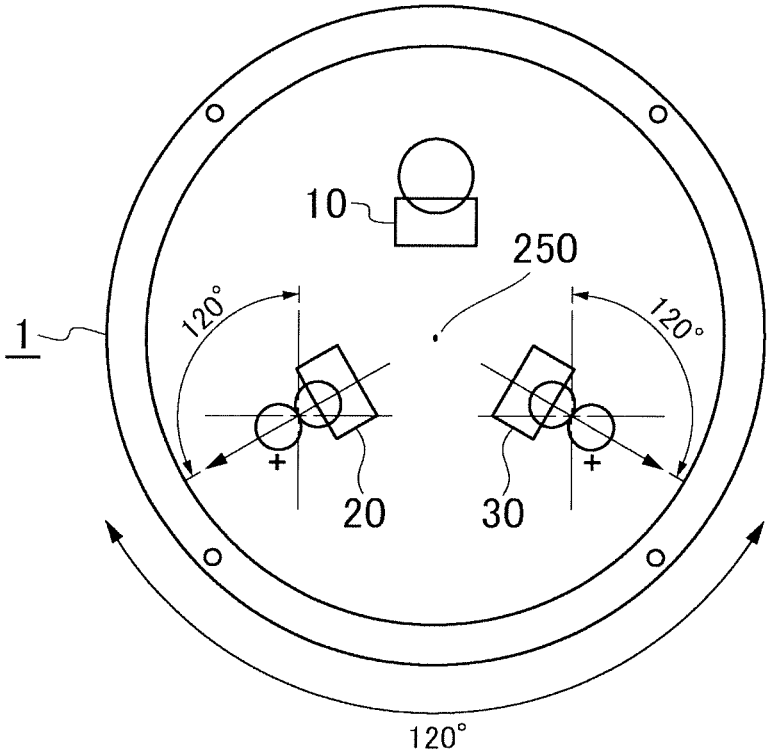
FIG. 3 is a plan view illustrating an arrangement example of the microphone units and directional characteristics of the microphone units.

FIG. 3 is a diagram obtained by adding, to the configuration illustrated in FIG. 2, patterns that indicate directivity characteristics of the microphone units 10, 20, and 30, reference lines that indicate positional relationships among the microphone units 10, 20 and 30, and the like. As illustrated in FIG. 3, the microphone units 10, 20, and 30 are arranged such that central portions of the respective units are positioned on straight lines radially extending at intervals of 120 degrees from center points of the lower case 15 and the substrate 25. Further, in this example, the microphone units 10, 20, and 30 are arranged such that the central portions of the respective units are positioned on a circumference centered at a center point (one point) 250 of the substrate 25.

Further, the bi-directional microphone units 20 and 30 are arranged such that respective directional axes are positioned on straight lines radially extending at angles of 120 degrees, respectively, with respect to a reference line that passes through the central portion of the omnidirectional microphone unit 10 from the center point of the substrate 25. Therefore, the bi-directional microphone units 20 and 30 are fixed and arranged on the substrate 25 such that the respective directional axes are positioned on two straight lines that pass through the center point (one point) 250 of the substrate 25, and radially extend with an interval of 120 degrees in a circumferential direction.

As can be seen from FIGS. 3, 4, and FIGS. 5A and 5B illustrating actually measured data, the omnidirectional microphone unit 10 has a characteristic of uniformly capturing a sound source in all directions. Meanwhile, as can be seen from FIGS. 3, 4, and FIGS. 6A and 6B illustrating actually measured data, the bi-directional microphone units 20 and 30 have a characteristic of strongly capturing sound sources in front-back two directions including a front side (0 deg) and an opposite side (180 deg) and of less easily capturing a sound source from a cross direction (90 deg). Hereinafter, description will be given on the assumption that directivity of capturing the sound source from the front side (the front, 0 deg) of each of the units is a positive (+) phase, and directivity of capturing the sound source from the opposite side (the rear, 180 deg) is a negative (−) phase, in the bi-directional microphone units 20 and 30. Further, hereinafter, a case of installing the microphone 1 on a table or the like such that a side where the omnidirectional microphone unit 10 is installed faces the front, and collecting sounds of a conference will be described.

Figure 4:
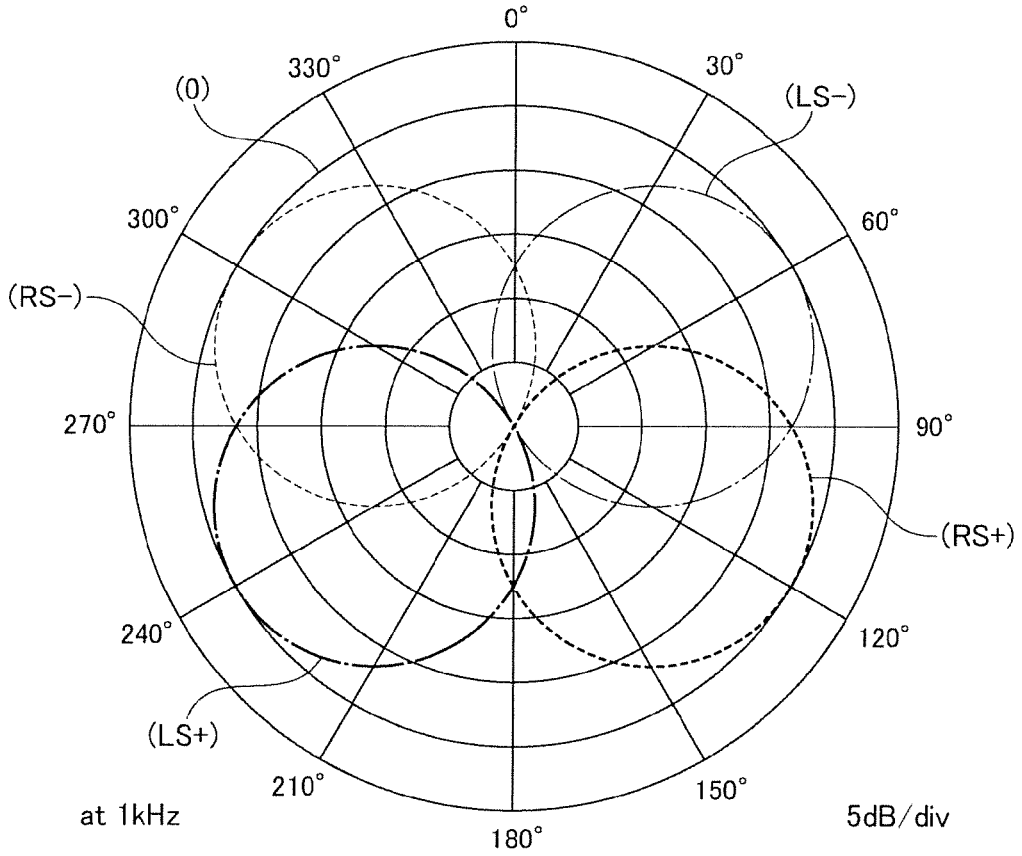
FIG. 4 is a graph illustrating directional characteristics of each of the microphone units.
Figure 5A:
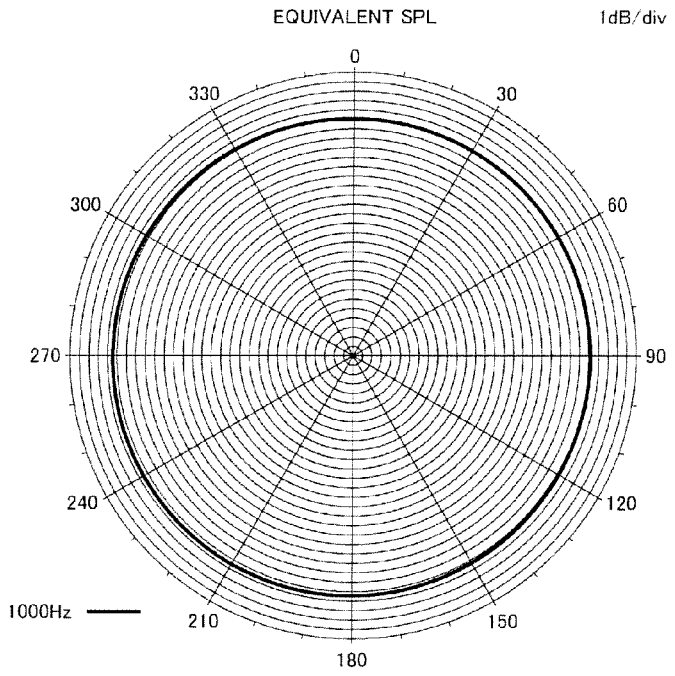
FIG. 5A is a graph illustrating measurement data of an output of an omnidirectional microphone unit, and illustrating directional characteristics of the omnidirectional microphone units.
Figure 5B:
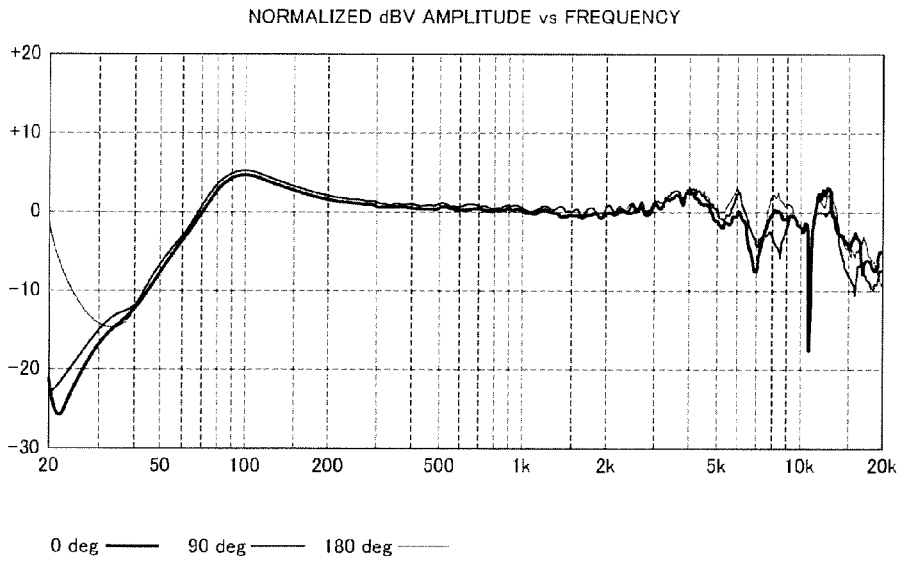
FIG. 5B is a graph illustrating measurement data of an output of an omnidirectional microphone unit, and illustrating frequency characteristics of the omnidirectional microphone unit in directions of 0 degrees, 90 degrees, and 180 degrees.
Figure 6A:
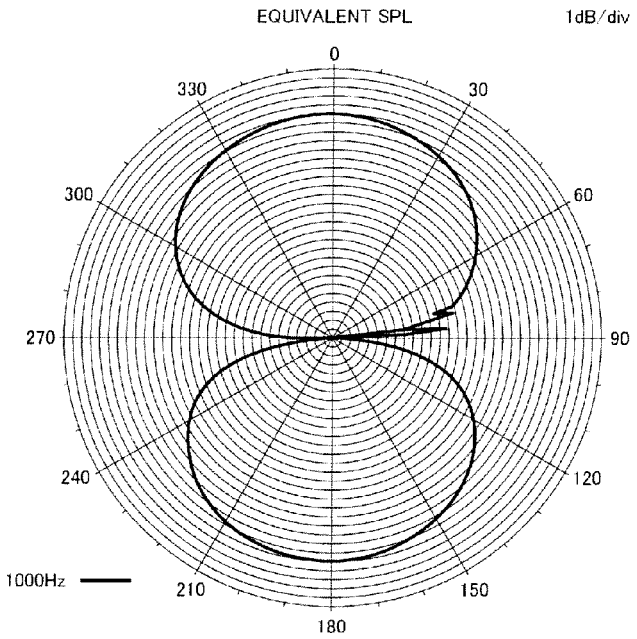
FIG. 6A is a graph illustrating measurement data of an output of a bi-directional microphone unit, and illustrating directional characteristics of the bi-directional microphone unit.
Figure 6B:
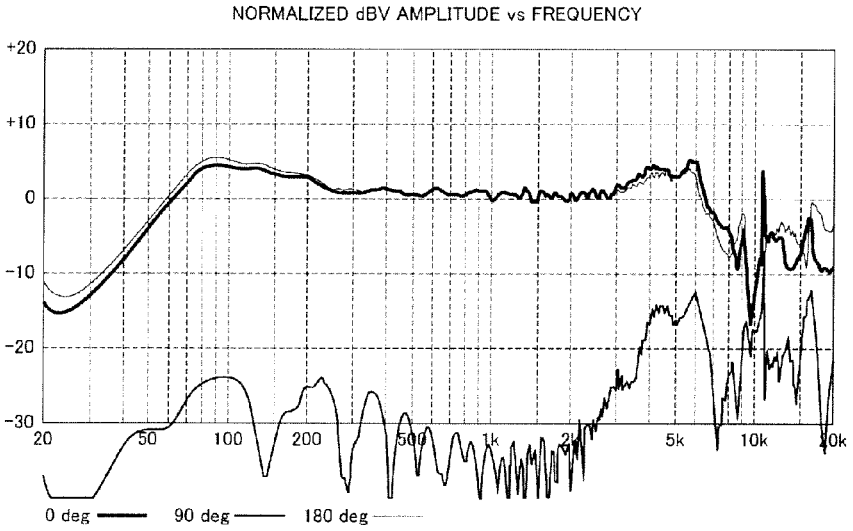
FIG. 6B is a graph illustrating measurement data of an output of a bi-directional microphone unit, and illustrating frequency characteristics of the bi-directional microphone unit in directions of 0 degrees, 90 degrees, and 180 degrees.

In FIG. 4, a directivity pattern of the omnidirectional microphone unit 10 is represented by "O", a directivity pattern of the left-side bi-directional microphone unit 20 is represented by "LS", and a directivity pattern of the right-side bi-directional microphone unit 30 is represented by "RS", respectively. Further, positive directivity patterns are respectively represented by "LS+" and "RS+", and negative directivity patterns are respectively represented by "LS−" and "RS−", respectively, in the bi-directional microphone units 20 and 30. In this example, as illustrated in FIG. 4, among the bi-directional microphone units 20 and 30, sensitivities, that is, output signal levels of when a constant sound pressure is received are mutually the same, and further, the sensitivities are also equal to sensitivity of the omnidirectional microphone unit 10.

Next, the signal amplification unit connected to the microphone 1 and the synthesis circuit 70 at a subsequent stage of the signal amplification unit will be described with reference to FIGS. 7 to 15. In the example below, the signal amplification unit is a separate body from the microphone 1. However, the signal amplification unit or the synthesis circuit 70 can be incorporated into the housing of the microphone 1.

Figure 7:
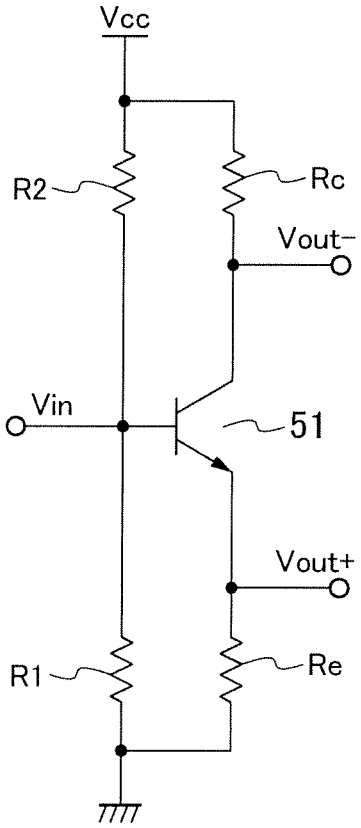
FIG. 7 is a circuit diagram illustrating an example of a circuit configuration of a signal amplification unit.

FIG. 7 illustrates an example of a circuit configuration of the signal amplification unit 40, 50, or 60. As illustrated in FIG. 7, the signal amplification unit to which the microphone unit 10, 20, or 30 is connected is a non-inverting/inverting amplification circuit. As illustrated in FIG. 7, the non-inverting/inverting amplification circuit is a balance output circuit in which bias resistances R1 and R2, an emitter resistance Re, and a collector resistance Rc are connected to a transistor 51. In the non-inverting/inverting amplification circuit, the microphone unit is connected to a base of the transistor 51, and the bias resistances R1 and R2 are connected to the base. The bias resistance R1 and the emitter resistance Re are grounded, and a voltage Vcc is applied to the bias resistance R2 and the collector resistance Rc.

The non-inverting/inverting amplification circuit amplifies the output signal of the microphone unit in the transistor 51, and outputs a positive-phase (+) signal from an emitter and a negative-phase (−) signal from a collector, respectively.

The signal amplification units 40, 50, and 60 illustrated in FIG. 1 can have the circuit configuration illustrated in FIG. 7. Note that the signal amplification circuit 40 connected to the omnidirectional microphone unit 10 may just output only a non-inverted amplified signal output from a Vout+ terminal illustrated in FIG. 7 to the synthesis circuit 70.

In this example, the signal amplification units 40, 50, and 60 are set to output an amplified signal of the same level to the synthesis circuit 70 when voltage levels of the input signals from the corresponding microphone units are equal to one another.

The synthesis circuit 70 in the embodiment illustrated in FIG. 1 synthesizes the five amplified signals supplied from the signal amplification units 40, 50, and 60 to generate three synthesized signals, and outputs the synthesized signals from the output terminals A, B, and C.

(Output of Output Terminal A)

Figure 9A:
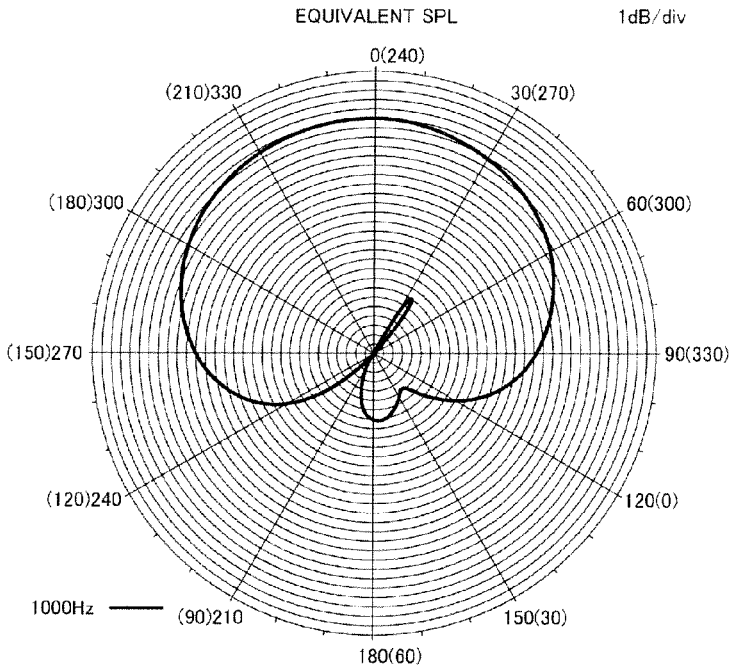
FIG. 9A is a graph illustrating data obtained by actually measuring an output of an "O+LS" signal of a synthesis circuit, and illustrating a directional characteristic of the "O+LS" signal.
Figure 9B:
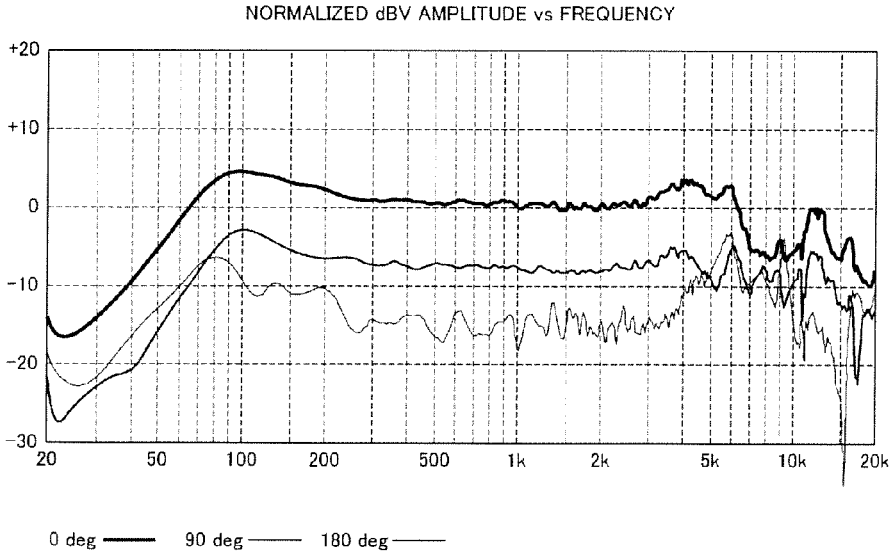
FIG. 9B is a graph illustrating data obtained by actually measuring an output of an "O+LS" signal of the synthesis circuit, and illustrating frequency characteristics of the "O+LS" signal in directions of 0 degrees, 90 degrees, and 180 degrees.

To be more specific, the synthesis circuit 70 synthesizes an amplified signal (hereinafter, referred to as "O signal") input from the signal amplification unit 40 with a positive-phase (+) amplified signal (hereinafter, referred to as "LS signal") input from the signal amplification unit 50 and outputs a synthesized signal from the output terminal A. By this synthesizing processing, the O signal based on the output signal of the omnidirectional microphone unit 10 and the LS signal based on the output signal of the bi-directional microphone unit 20 are synthesized, and an "O+LS" output signal is generated. Measurement data obtained by actually measuring the "O+LS" output signal is illustrated in FIGS. 9A and 9B. Regarding FIG. 9A, because of the specification of used measuring equipment, a direction of the highest sensitivity is 0° and a signal is output based on the direction. However, actual directions (angles) are the numerical values with brackets added to FIG. 9A based on the installation direction of the microphone 1.

Figure 10:
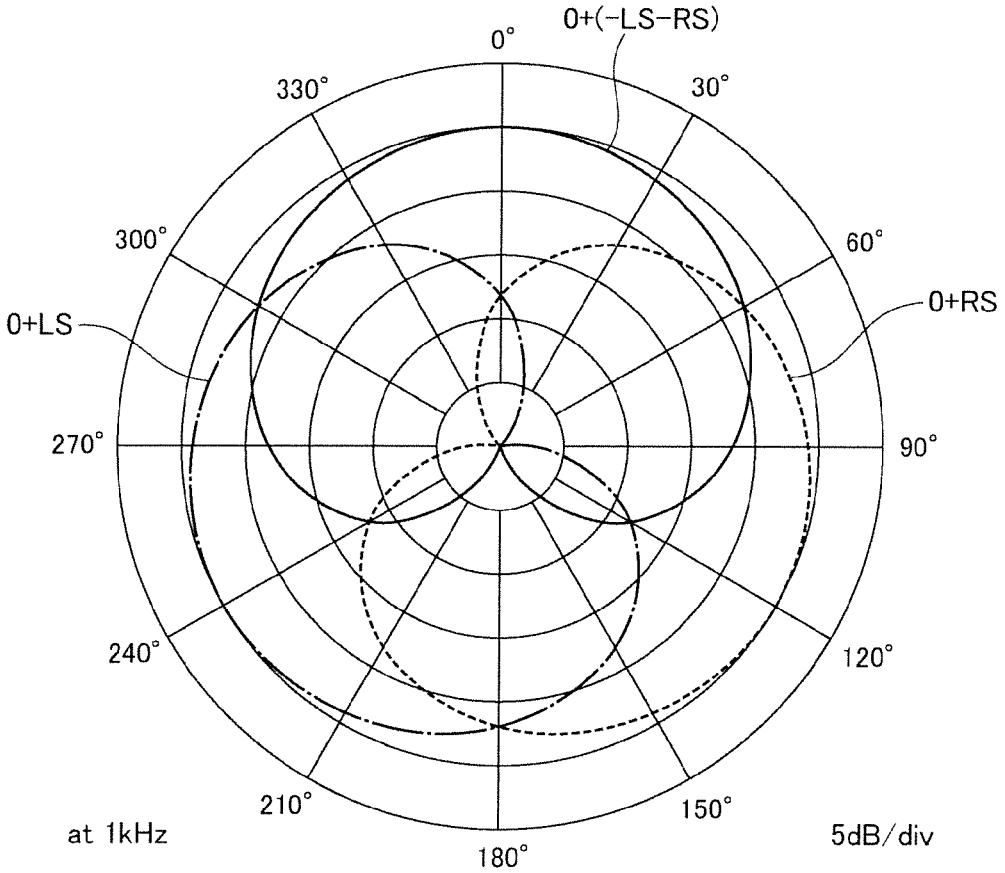
FIG. 10 is a graph illustrating directional characteristics that can be obtained in the embodiment of the microphone apparatus illustrated in FIG. 1.

It can be seen that, in this O+LS output signal, a sound of a sound source from a direction of being rotated leftward by 120 degrees from a front side (the front) of the installed microphone 1 is intensified, as illustrated in FIGS. 1, and 9A and 9B. Further, it can be seen that, in the O+LS output signal, a sound of a sound source from an opposite side, that is, a direction of being rotated rightward by 60 degrees from the front is weakened. In other words, the O+LS output signal is a unidirectional signal by a cardioid curve with a directional axis facing leftward by 120 degrees. Therefore, a unidirectional output signal by a cardioid shape characteristic with a directional axis rotated leftward by 120 degrees can be obtained from the output terminal A as illustrated in FIG. 10.

(Output of Output Terminal B)

The synthesis circuit 70 synthesizes the O signal input from the signal amplification unit 40 with a positive-phase (+) amplified signal (hereinafter, referred to as "RS signal") input from the signal amplification unit 60, and outputs a synthesized signal from an output terminal B. By this synthesizing processing, the O signal based on the output signal of the omnidirectional microphone unit 10 and the RS signal based on the output signal of the bi-directional microphone unit 30 are synthesized, and an "O+RS" output signal is generated.

It can be seen that, in this O+RS output signal, a sound of a sound source from a direction of being rotated rightward by 120 degrees from the front side (the front) of the installed microphone 1 is intensified, and a sound of a sound source from an opposite side, that is, a direction of being rotated leftward by 60 degrees from the front is weakened, as illustrated in FIG. 1. In other words, the O+RS output signal is a unidirectional signal by a cardioid curve with a directional axis facing rightward by 120 degrees. Therefore, a unidirectional output signal by a cardioid shape characteristic with a directional axis rotated rightward by 120 degrees can be obtained from the output terminal B, as illustrated in FIG. 1.

(Output of Output Terminal C)

The synthesis circuit 70 synthesizes the O signal input from the signal amplification unit 40, a negative-phase (−) amplified signal (hereinafter, referred to as "−LS signal") input from the signal amplification unit 50, and a negative-phase (−) amplified signal (hereinafter, referred to as "−RS signal") input from the signal amplification unit 60. The synthesis circuit 70 outputs a synthesized signal, that is, an O+(−LS−RS) signal from an output terminal C.

Figure 11A:
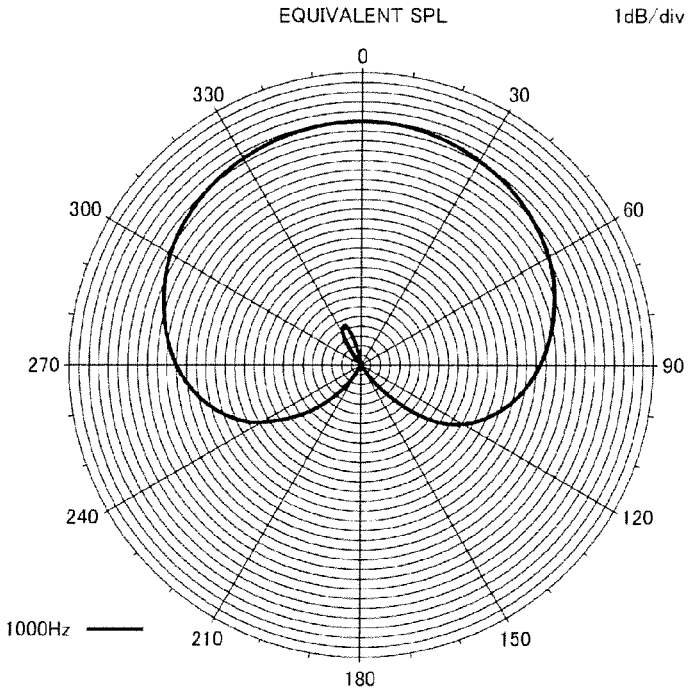
FIG. 11A is a graph illustrating data obtained by actually measuring an output of an "O+(−LS−RS)" signal of the synthesis circuit, and illustrating a directional characteristic of the "O+(−LS−RS)" signal.
Figure 11B:
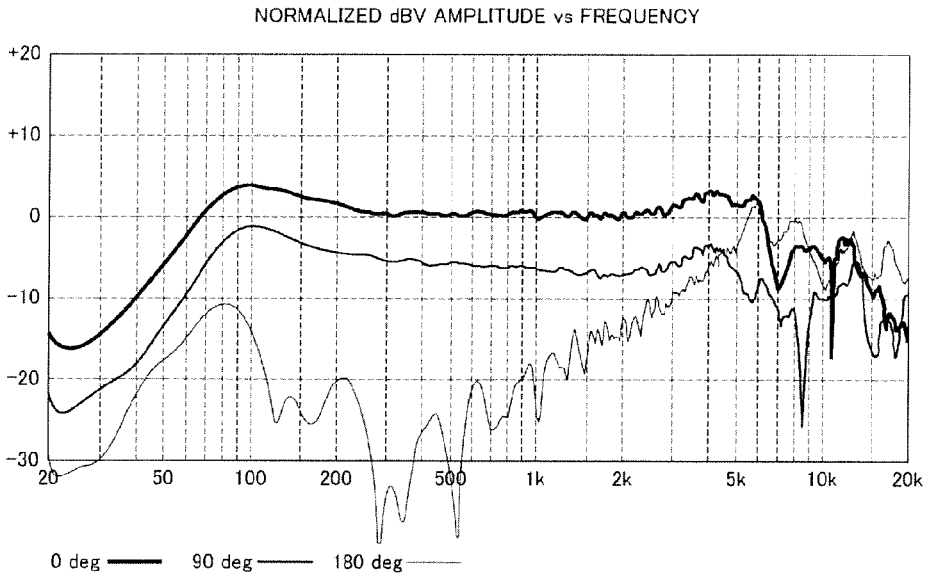
FIG. 11B is a graph illustrating data obtained by actually measuring an output of an "O+(−LS−RS)" signal of the synthesis circuit, and illustrating frequency characteristics of the "O +(−LS−RS)" signal in directions of 0 degrees, 90 degrees, and 180 degrees.

As illustrated in FIG. 1, in this O+(−LS−RS) output signal, a sound of a sound source from the front (forward) direction of the installed microphone 1 is intensified, and a sound of a sound source from an opposite side, that is, a rearward direction is weakened. Diagrams of measurement data obtained by actually measuring an output signal of the O+(−LS−RS) output signal are illustrated in FIGS. 11A and 11B.

For easy understanding, FIG. 1 additionally illustrates a characteristic diagram of the (−LS−RS) signal as an intermediate signal. As can be seen from the characteristic diagram, the (−LS−RS) signal is a bi-directional signal with a directional axis facing the front.

By synthesizing the O signal with the (−LS−RS) signal, a unidirectional signal by a cardioid curve with a directional axis facing the front (forward) direction is obtained as the O+(−LS−RS) signal. Therefore, a unidirectional output signal by a cardioid shape characteristic with a directional axis facing the front (forward) can be obtained from the output terminal C, as illustrated in FIGS. 1, and 11A and 11B.

As described above, the output signal by a cardioid shape characteristic with a directional axis rotated leftward by 120 degrees is obtained from the output terminal A, and the output signal by a cardioid shape characteristic with a directional axis rotated rightward by 120 degrees is obtained from the output terminal B. Further, the output signal by a cardioid shape characteristic with a directional axis facing the front (forward) is obtained from the output terminal C. Therefore, in the microphone apparatus illustrated in FIG. 1, output signals having three unidirectivities where the directions of the directional axes are mutually shifted by 120 degrees are output from the mutually different output terminals. Here, by selecting one of the output terminals A, B, and C, the directional axis of the unidirectional microphone can be easily switched with an electrical switching operation.

Next, another embodiment of a microphone apparatus including a synthesis circuit having a different configuration will be described with reference to FIG. 8.

(Output of Output Terminal A)

Figure 8:
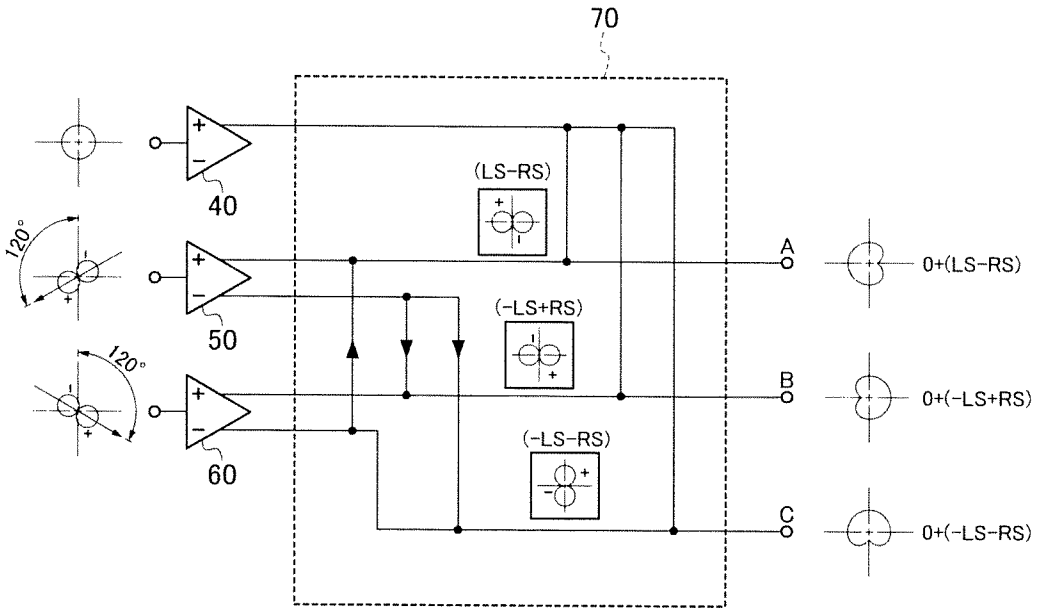
FIG. 8 is a circuit diagram illustrating another embodiment of a microphone apparatus according to the present invention.

In FIG. 8, a synthesis circuit 70 synthesizes an O signal input from a signal amplification unit 40, an LS signal input form a signal amplification unit 50, and a −RS signal input from a signal amplification unit 60 to generate an O+(LS−RS) output signal, and outputs a synthesized signal from an output terminal A.

It can be seen that, in this O+(LS−RS) output signal, a sound of a sound source from a left direction of an installed microphone 1 by 90 degrees is intensified, and a sound of a sound source from an opposite side, that is, a right direction by 90 degrees is weakened, as illustrated in FIG. 8.

For easy understanding, FIG. 8 additionally illustrates a characteristic diagram of an (LS−RS) signal as an intermediate signal. As can be seen from the characteristic diagram, the (LS−RS) signal is a bi-directional signal with a directional axis facing leftward by 90 degrees. By synthesizing the O signal with the (LS−RS) signal, a unidirectional signal by a cardioid curve with a directional axis facing leftward by 90 degrees is obtained as an O+(LS −RS) signal. Therefore, a unidirectional output signal by a cardioid shape characteristic with a directional axis facing leftward by 90 degrees can be obtained from the output terminal A, as illustrated in FIG. 8.

(Output of Output Terminal B)

The synthesis circuit 70 synthesizes the O signal input from the signal amplification unit 40, a −LS signal input from the signal amplification unit 50, and an RS signal input from the signal amplification unit 60 to generate an O+(−LS+RS) output signal, and outputs a synthesized signal from an output terminal B.

It can be seen that, in this O+(−LS+RS) output signal, a sound of a sound source from a right direction of the installed microphone 1 by 90 degrees is intensified, and a sound of a sound source from an opposite side, that is, a left direction by 90 degrees is weakened, as illustrated in FIG. 8.

For easy understanding, FIG. 8 additionally illustrates a characteristic diagram of a (−LS+RS) signal as an intermediate signal. As can be seen from the characteristic diagram, the (−LS+RS) signal is a bi-directional signal with a directional axis facing rightward by 90 degrees. By synthesizing the (−LS+RS) signal with the O signal, a synthesized signal becomes a unidirectional signal by a cardioid curve with a directional axis facing rightward by 90 degrees, as the O+(−LS+RS) signal. Therefore, a unidirectional output signal by a cardioid shape characteristic with a directional axis facing rightward by 90 degrees can be obtained from the output terminal B as illustrated in FIG. 8.

(Output of Output Terminal C)

An negative-phase (−) amplified signal (−RS signal) input from the signal amplification unit 60 is synthesized with a −LS signal from the signal amplification unit 50 and the O signal from the signal amplification unit 40, similarly to FIG. 1. Therefore, an O+(−LS−RS) signal, which is the same as that in FIG. 1, is output from an output terminal C.

As described above, in the embodiment illustrated in FIG. 8, the output signal by an approximate cardioid shape characteristic with a directional axis rotated leftward by 90 degrees is obtained from the output terminal A, and the output signal by an approximate cardioid shape characteristic with a directional axis rotated rightward by 90 degrees is obtained from the output terminal B. Further, the output signal by a cardioid shape characteristic with a directional axis facing forward is obtained from the output terminal C.

Even in the embodiment illustrated in FIG. 8, by selecting one of the output terminals A, B, and C with an electrical switching operation, the directional axis of the unidirectional microphone can be easily switched.

As described above, in the present embodiment, the directional axes of the pair of right and left bi-directional microphone units 20 and 30 are arranged on the two straight lines passing through one point and radially extending with an interval of 120 degrees in a circumferential direction. In addition, the omnidirectional microphone is arranged in sound collection regions of the bi-directional microphone units 20 and 30. Accordingly, the direction of the directional axis can be easily changed by electrical processing.

That is, in the present embodiment, it is not necessary to change the physical positions of the microphone units in the housing and also not necessary to touch the microphone 1 in order to change the directions of the directional axes like a conventional configuration using three unidirectional microphone units. Therefore, according to the present embodiment, it is not necessary to provide a complicated mechanism for position change of the microphone units like a conventional case. In addition, there are no restrictions on the installation place of the microphone.

The circuits illustrated in FIGS. 1 and 8 have been described as mutually different embodiments. However, the configuration of the synthesis circuit 70 illustrated in FIG. 1 and the configuration of the synthesis circuit 70 illustrated in FIG. 8 may be switched with a switch.

In a case of using the switch, a configuration to switch connections of FIGS. 1 and 8, that is, ON/OFF states for changing the direction of the directional axis with a physical interlock switch can be employed.

As another example, a configuration to separately switch the connections of FIGS. 1 and 8, that is, ON/OFF states, with two individual switches, may be employed. In this case, an output signal by an approximate cardioid shape characteristic in a form where one directional axis is rotated in a cross direction by 90 degrees, and the other directional axis is rotated by 120 degrees can be obtained.

Further, as another example, a configuration to control the switching of the switch using a personal computer (PC) or the like in a software manner can be employed.

(Level Adjustment Unit)

Further, to continuously change the characteristics of the directivities of the signals output from the output terminals A, B, and C, a level adjustment unit that adjusts a level of the output signal of the microphone unit (10 to 30) can be provided in the signal amplification unit (40 to 60).

Figure 12:
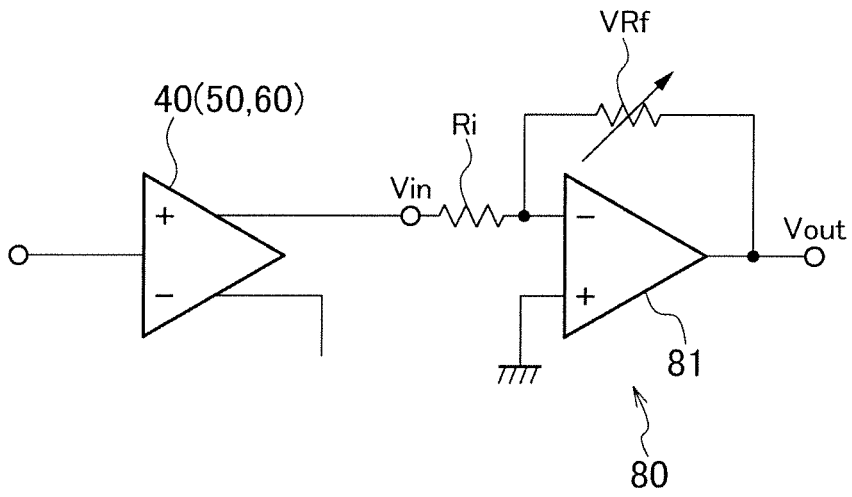
FIG. 12 is a circuit diagram illustrating an example of an output level adjustment circuit of a microphone unit.

FIG. 12 illustrates a circuit configuration example in which the level adjustment unit is provided in each output line of the signal amplification unit 40, 50, or 60. This level adjustment unit 80 is a circuit having an input resistance Ri connected to a minus side input terminal of an operational amplifier 81 and a feedback resistance connected between an output side and the minus side input terminal of the operational amplifier 81. A variable resistor VRf is used for the feedback resistance of the level adjustment unit 80. In the level adjustment unit 80, an amplification factor of the operational amplifier is determined according to a ratio of a resistance value set in the variable resistor VRf to a resistance value of the input resistance Ri. Therefore, by providing the level adjustment unit 80 in each output line of the signal amplification unit 40, 50, or 60 and adjusting the variable resistor VRf of the level adjustment unit 80, the output signal level of each microphone unit can be adjusted.

Figure 13:
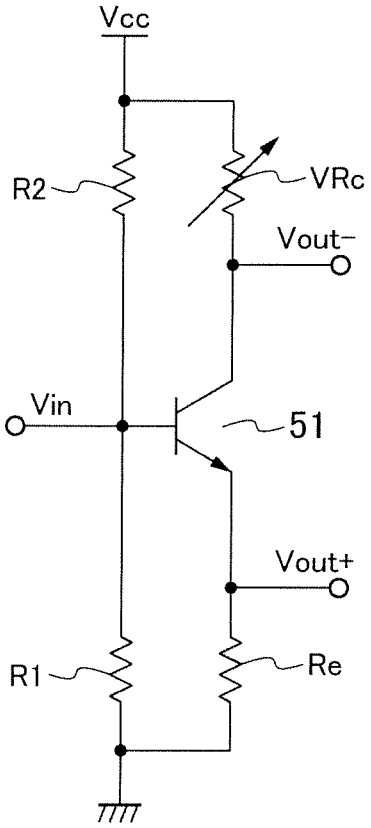
FIG. 13 is a circuit diagram illustrating another example of an output level adjustment circuit of a microphone unit.

FIG. 13 illustrates a circuit configuration example in which the level adjustment unit is provided in the signal amplification unit (non-inverting/inverting amplification circuit) 40, 50, or 60 connected to the microphone unit 10, 20, or 30. This non-inverting/inverting amplification circuit includes a variable resistor VRc in place of the collector resistance connected to the transistor 51 in the non-inverting/inverting amplification circuit illustrated in FIG. 7. According to the non-inverting/inverting amplification circuit illustrated in FIG. 13, by adjusting a resistance value of the variable resistor VRc, the output signal level of the negative-phase (−) signal of the microphone unit, and a the positive-phase (+) output signal level can be adjusted.

Further, circuits equivalent to the level adjustment unit illustrated in FIG. 12 can be provided to subsequent stages of the output terminals A to C of the synthesis circuit 70. With such a configuration, the output levels of the three-phase signals supplied to an external apparatus can be individually adjusted.

(Microphone Sensitivity Adjustment Unit)

Figure 14:
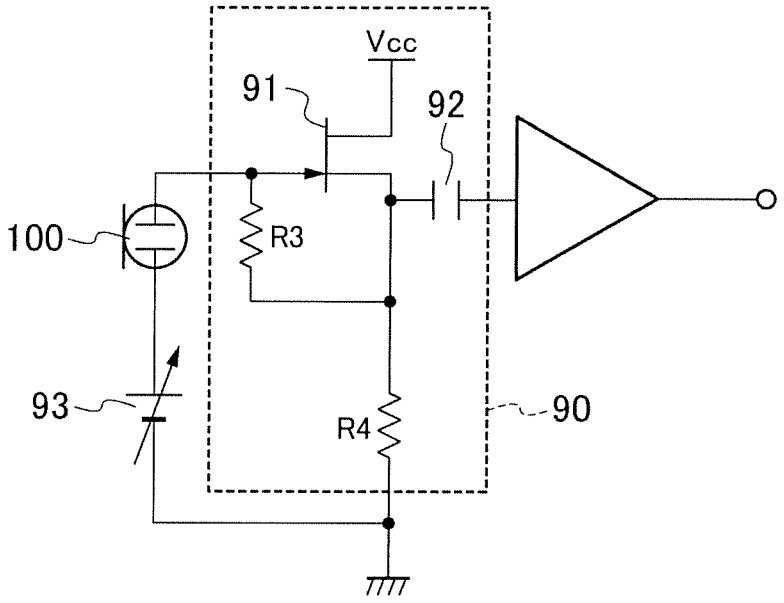
FIG. 14 is a circuit diagram illustrating still another example of an output level adjustment circuit of a microphone unit.

Further, to continuously change the characteristics of the directivities of the signals output from the output terminals A, B, and C, a sensitivity adjustment unit of the microphone unit can be provided between the microphone unit (10 to 30) and the signal amplification unit (40 to 60). FIG. 14 illustrates an example of a circuit configuration of a sensitivity adjustment unit using a condenser microphone as a microphone unit 100 (microphone unit being representative of any or all of microphone units 10 to 30 discussed above).

The sensitivity adjustment unit illustrated in FIG. 14 includes an impedance converter 90 using an FET 91, resistances R3 and R4, and a condenser 92, and has a configuration to make an output voltage of a phantom power supply 93 variable, the phantom power supply 93 supplying a polarization voltage to the condenser microphone.

The phantom power supply 93 is supplied from a mixer. However, in FIG. 14, the phantom power supply 93 is illustrated in a simplified manner as if it exists near the microphone unit 100. Voltage adjustment of the phantom power supply 93 can be performed at the mixer.

Figure 15:
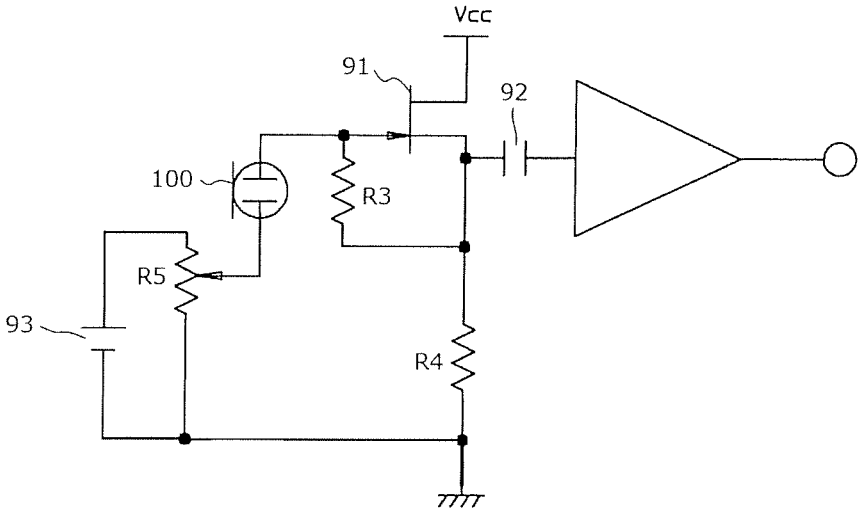
FIG. 15 is a circuit diagram illustrating a circuit configuration of FIG. 14 in more detail.

Further, in FIG. 14, the phantom power supply itself is illustrated like a variable voltage power supply. However, in reality, the voltage of the phantom power supply is converted through a DC-DC converter or a regulator. A specific circuit configuration to make the voltage of the phantom power supply variable is illustrated in FIG. 15. In the circuit illustrated in FIG. 15, the phantom power supply 93 and a variable resistance R5 are connected in parallel, and one of terminals of the microphone unit 100 is connected to a variable terminal of the variable resistance R5, so that a voltage value applied to the microphone unit 100 is adjusted. By adjusting the output voltage value of the phantom power supply 93 as described above, sensitivity of the microphone unit is adjusted, and the signal level output from the microphone unit to the signal amplification unit is adjusted.

By providing the sensitivity adjustment units illustrated in FIGS. 14 and 15 to the microphone units 10, 20, and 30 illustrated in FIGS. 1 and 8, influence of the microphone units 10, 20, and 30 is changed in the signal synthesized in the synthesis circuit 70. As a result, the directions of the unidirectional directional axes output from the terminals A, B, and C are continuously changed. The patterns of the directivities are also changed at the same time.

For example, in the omnidirectional microphone unit 10, by setting the output voltage value of the phantom power supply 93 to be large, the pattern characteristics of the signals output from the output terminals A to C become more omnidirectional. On the other hand, by setting the output voltage value of the phantom power supply 93 to be small, the degree of reflection of the omnidirectional pattern characteristics in the signals output from the output terminals A to C becomes small.

By arbitrarily adding the sensitivity adjustment units and the level adjustment units as described above, the directional characteristics of the output signals supplied to an external device can be individually and continuously adjusted.

To be specific, by adjusting a synthesis ratio of the outputs of the bi-directional microphone units 20 to 30, the directional axis can be continuously changed in an arbitrary direction. For example, when the synthesis ratio of the bi-directional microphone unit 30 to the bi-directional microphone unit 20 is continuously made large, the direction of the directional axis of the signal to be synthesized can be continuously tilted toward the directional axis of the bi-directional microphone unit 30.

Further, by adjusting the synthesis ratio of the output of the bi-directional microphone unit 20 or 30 to the omnidirectional microphone unit 10, the pattern shape of the directional characteristics can be freely changed from a cardioid shape into a hyper cardioid shape or the like.

The microphone apparatus according to the present invention is expected to be used for various intended purposes such as a table-installation microphone suitable for sound collection of conferences and a microphone installed in a concert hall, for sound collection of music performance.

The connection forms in the synthesis circuit 70, that is, the synthesis forms of the signals illustrated and described in FIGS. 1 and 8 are examples. The synthesis circuit 70 may just synthesize at least one of the non-inverted signals and the inverted signals output from the bi-directional microphone units 20 and 30, and the output signal of the omnidirectional microphone unit to generate two or more output signals having mutually different directivities.

The number of the output terminals (A, B, and C) in the synthesis circuit 70 is also an example. In the synthesis circuit 70, an output terminal that outputs the output signal of the bi-directional microphone unit 20 or 30 as it is without synthesizing the output signal, an output terminal that continuously changes and outputs the direction of the directional axis or the pattern shape of the directional characteristic may be additionally provided. By increasing the number of the signals output from the synthesis circuit 70 as described above, sound collection of 5 channels or more can be performed.

The switching of the direction of the directional axis and the adjustment of the microphone sensitivity by the output characteristics in the output signal processing unit, that is, the synthesis forms of the input signals may be performed by a configuration of a manual switching operation or a manual adjustment operation, or another configuration. For example, the direction of the sound source is detected for sound field collection, and the switching and the adjustment may be automatically performed such that the direction of the directional axis corresponds to the detected sound source direction. In this case, output wires of the microphone units 10, 20, and 30 are branched and connected to a control apparatus such as a personal computer, and control based on outputs of the microphone units 10, 20, and 30, which have been detected by the control apparatus, may just be performed. This control includes the switching of the switch of the synthesis circuit 70, the synthesis forms of the signals in the synthesis circuit 70, and the adjustment of the resistance value of the various types of variable resistors.

In the present embodiment, an example in which the microphone units 10, 20, and 30 are condenser microphone units has been described. For example, one or both of the two bi-directional microphone units 20 and 30 can be ribbon microphone units.

In the present embodiment, each of the microphone units 10, 20, and 30 is respectively positioned on the three straight lines passing through the one point (the center point of the substrate 25) and radially extending at intervals of 120 degrees in the circumferential direction. However, the position of the omnidirectional microphone unit 10 is not limited thereto. The position of the omnidirectional microphone unit 10 may just be arranged in the sound collection regions of the bi-directional microphone units 20 and 30. Therefore, the omnidirectional microphone unit 10 can be provided in an arbitrary position such as the center of the substrate 25, a position near the center, a vicinity of any of the bi-directional microphone units 20 and 30. The direction of the omnidirectional microphone unit is arbitrary.

Meanwhile, from the perspective of aligning the phases of the output signals among the microphone units 10, 20, and 30 as much as possible, at least diaphragms of the bi-directional microphone units 20 and 30 are favorably arranged on the same plane.

Design change of the microphone apparatus according to the present invention can be made without departing from the technical ideas described in claims.

What is claimed is:

1. A microphone apparatus comprising:

a microphone including first and second bi-directional microphone units having respective directional axes arranged on two straight lines passing through one point and radially extending with an interval of 120 degrees in a circumferential direction, and an omnidirectional microphone unit arranged in sound collection regions of the first and second bi-directional microphone units;

a signal synthesis unit configured to synthesize one of respective non-inverted signals and inverted signals of the first and second bi-directional microphone units and an output signal of the omnidirectional microphone unit to generate a plurality of output signals having directional axes in mutually different directions;

a first signal processing unit configured to invert a phase of a positive-phase output signal from the first bi-directional microphone unit to generate the inverted signal, and output the positive-phase output signal and the inverted signal to the signal synthesis unit; and a second signal processing unit configured to invert a phase of a positive-phase output signal from the second bi-directional microphone unit to generate the inverted signal, and output the positive-phase output signal and the inverted signal to the signal synthesis unit.

2. The microphone apparatus according to claim 1, wherein the first and second bi-directional microphone units and the omnidirectional microphone unit are arranged such that respective central portions are positioned on a circumference, and the one point is a center point of the circumference.

3. The microphone apparatus according to claim 1, comprising:

a third signal processing unit configured to amplify the output signal of the omnidirectional microphone unit, and supply the amplified output signal to the signal synthesis unit, wherein the first and second signal processing units respectively perform non-inverting amplification or inverting amplification for the output signals of the corresponding bi-directional microphone units, and supply signals subjected to the non-inverting amplification or inverting amplification to the signal synthesis unit.

4. The microphone apparatus according to claim 3, wherein first, second and third signal processing units are non-inverting/inverting amplification circuits, each of the non-inverting/inverting amplification circuits is a balance output circuit, the balance output circuit comprises a transistor, an emitter resistance and a collector resistance connected to the transistor, wherein the non-inverting amplification and the inverting amplification for the output signals are derived from the emitter resistance and the collector resistance.

5. The microphone apparatus according to claim 1, wherein the signal synthesis unit includes first to third output terminals, and outputs the plurality of generated output signals from different terminals in the first to third output terminals, respectively.

6. The microphone apparatus according to claim 5, wherein the signal synthesis unit outputs output signals having three unidirectivities with directional axes in mutually different directions from the mutually different output terminals.

7. The microphone apparatus according to claim 5, wherein the signal synthesis unit adds the non-inverted signal from the first bi-directional microphone unit to the output signal from the omnidirectional microphone unit and outputs an added signal from the first output terminal, adds the non-inverted signal from the second bi-directional microphone unit to the output signal from the omnidirectional microphone unit and outputs an added signal from the second output terminal, and adds the inverted signal from the first bi-directional microphone unit and the output signal from the omnidirectional microphone unit to the inverted signal from the second bi-directional microphone unit, and outputs an added signal from the third output terminal.

8. The microphone apparatus according to claim 5, wherein the signal synthesis unit outputs output signals having three unidirectivities in which directions of directional axes are mutually shifted by 120 degrees, from the mutually different output terminals.

9. The microphone apparatus according to claim 5, wherein the signal synthesis unit synthesizes the output signal from the omnidirectional microphone unit, the non-inverted signal from the first bi-directional microphone unit, and the inverted signal from the second bi-directional microphone unit and outputs a synthesized signal from the first output terminal, synthesizes the output signal from the omnidirectional microphone unit, the non-inverted signal from the second bi-directional microphone unit, and the inverted signal from the first bi-directional microphone unit, and outputs a synthesized signal from the second output terminal, and adds the inverted signal from the first bi-directional microphone unit and the output signal from the omnidirectional microphone unit to the inverted signal from the second bi-directional microphone unit, and outputs all added signal from the third output terminal.

10. The microphone apparatus according to claim 9, wherein the signal synthesis unit outputs output signals having three unidirectivities in which directions of directional axes are mutually shifted by 90 degrees, from the mutually different output terminals.

11. The microphone apparatus according to claim 1, wherein a sensitivity ad justment unit that adjusts sensitivity of the microphone is included in at least one of the microphone units.

12. The microphone apparatus according to claim 11, wherein one or more of the microphone units are condenser microphones, the sensitivity adjustment unit comprises a voltage adjustment means which adjusts a voltage derived from a phantom power supply of at least one condenser microphone of the condenser microphones for supplying to bias resistances connected to the at least one condenser microphone.

13. The microphone apparatus according to claim 1, wherein a level adjustment unit that adjusts a level of the output signal of the corresponding microphone unit is included in at least one of the signal processing units.

14. The microphone apparatus according to claim 1, wherein the first and second bi-directional microphone units are arranged on a circumference having the one point as a center point.

15. The microphone apparatus according to claim 1, wherein the omnidirectional microphone unit and the first and second bi-directional microphone unit are arranged on a circumference having the one point as a center point with intervals of 120 degrees respectively.

16. The microphone apparatus according to claim 1, wherein the omnidirectional microphone unit is arranged on the one point.

* * * * *